US006212720B1

(12) United States Patent
Antinori et al.

(10) Patent No.: US 6,212,720 B1
(45) Date of Patent: Apr. 10, 2001

(54) MATTRESS TUB

(75) Inventors: Steven J. Antinori, 4908 St. Croix Dr., Tampa, FL (US) 33629; Brent Agar, Valrico, FL (US)

(73) Assignee: Steven J. Antinori, Tampa, FL (US)

( * ) Notice: Subject to any disclaimer, the term of this patent is extended or adjusted under 35 U.S.C. 154(b) by 0 days.

(21) Appl. No.: 09/520,981

(22) Filed: Mar. 8, 2000

(51) Int. Cl.[7] ..... A47C 27/05; A47C 27/16; A47C 27/15

(52) U.S. Cl. ..... 5/727; 5/716; 5/740

(58) Field of Search ..... 5/727, 716, 736, 5/740, 655.9

(56) References Cited

U.S. PATENT DOCUMENTS 3,766,577 * 10/1973 Stewart ..... 5/740
4,109,332 * 8/1978 Lück ..... 5/655.9
4,432,110 * 2/1984 Sutton ..... 5/655.9
4,862,539 * 9/1989 Bokich ..... 5/655.9
5,317,768 6/1994 Klancnik ..... 5/736
5,636,397 * 6/1997 Boyd et al. ..... 5/740

* cited by examiner

*Primary Examiner*—Alexander Grosz
(74) *Attorney, Agent, or Firm*—Diller, Ramik & Wight

(57) ABSTRACT

A mattress includes at least in part a center convoluted foamed latex layer having opposite ends and opposite sides, a substantially flat lower surface and an opposite convoluted upper surface with the convoluted surface including a plurality of upwardly directed peaks and upwardly opening valleys. An upper layer of polymeric/copolymeric material spans the convoluted upper surface with a lower surface of the upper layer being substantially contiguous to the peaks and substantially closing the valleys. A frame of polymeric/copolymeric material substantially peripherally surrounds the convoluted layer and has an upper surface in underlying bonded relationship to the upper layer upper surface. A plurality of randomly sized pieces of foamed latex are housed within and substantially fill the valleys thereby progressively resisting compression of the peaks under the influence of different weights of persons supported upon the upper layer while imparting softness comparable to mattresses constructed entirely of solid unconvoluted foamed latex.

18 Claims, 1 Drawing Sheet

FIG. 1
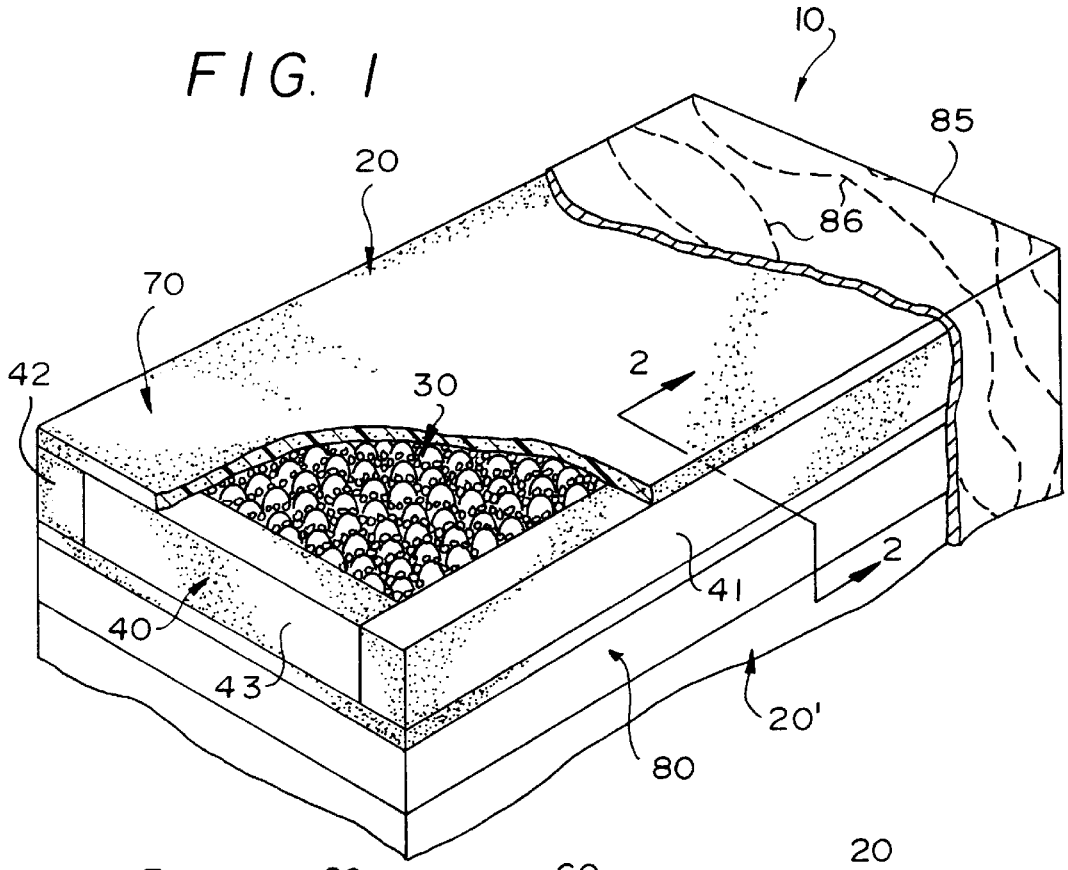
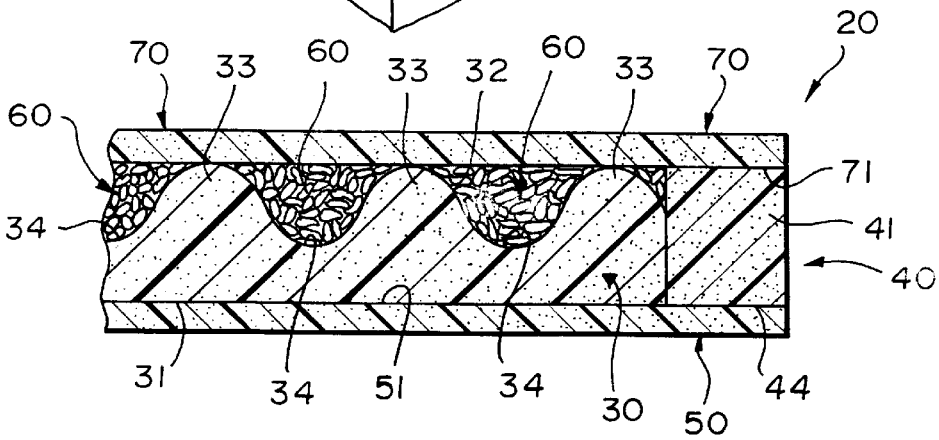
FIG. 2

MATTRESS TUB

BACKGROUND OF THE INVENTION

The invention is directed to a mattress tub which forms the upper support portion of a mattress and can as well form a lower support portion which essentially becomes uppermost when the mattress is turned or flipped in the customary fashion. The construction of the mattress tub directly affects the comfort and "feel" of the mattress because it is the support portion upon which a sleeper or patient rests and is thereby supported.

Upper support portions of the type described are relatively common, as is reflected by the disclosure of U.S. Pat. No. 5,317,768 in the name of Alvin R. Klancnik granted on Jun. 7, 1994. This patent discloses a mattress which is formed by a coil spring structure, a bottom cloth layer thereabove, next a convoluted foam layer having upwardly directed peaks and upwardly opening valleys, and spanning and covering all the latter are an upper fiber layer and an outermost cloth layer with all of the components, excluding the coil spring structure, being held together by stitching. The patent recognizes inherent problems in a mattress of this type, such as the crushing of the fiber material which causes a loss in resilience and prevents the same from returning to its original position even after weight has been removed. Another disadvantage of the mattress is said to be the retention of moisture by the top surface should a sleeper perspire. Once wet, the fiber is slow to dry and the retained moisture is said to result in an unpleasant aroma. The problem of such mattresses is resolved by the patent disclosure through the utilization of the convoluted foam layer, located beneath the fiber layer, having upwardly directed peaks which are partially compressed when weight (a person or sleeper) is applied thereto and which return to their no-load position once weight is removed. This is said to move or exercise the fiber layer thereby reducing matting and also forces air movement which dries any moisture from the fiber layer. The convoluted foam layer in the top surface also increases the comfort or softness of the mattress since the peaks are quick to respond to a weight by compressing.

SUMMARY OF THE INVENTION

The present invention is directed to a mattress which includes a mattress tub which not only provides all of the advantages of known prior art mattress tubs, but also provides comfort, feel and softness comparable to mattresses constructed entirely of foamed latex which are recognized in the trade as superior mattresses at the high end of comfort and cost. The mattress tub of the invention substantially eliminates the quick peak compression of known mattresses of the type described utilizing a convoluted foam layer and instead achieves progressive compression toward full compression through the utilization of a plurality of randomly sized pieces of foamed latex or latex foam housed within and substantially filling the valleys of the convoluted foam layer. In this fashion when weight is applied to an upper surface of the mattress and the mattress tub thereof, the plurality of randomly sized pieces of foamed latex are progressively themselves moved intimately against one another into a mass and as the peaks of the convoluted foam layer compress, the pieces of foam latex also progressively compress thereby providing progressive compression toward full compression which in turn provides superb comfort through automatic ergonomic contouring of the mattress pad to both the shape and weight distribution of a person lying thereupon. For example, the portion of the mattress tub underlyingly supporting the hips of a person would be compressed the most, the shoulder portion of the sleeper next most, and the feet and head of the sleeper the least. Hence, the peaks of the convoluted latex foam layer in the area of the person's hips would be compressed to a maximum, the valleys reduced correspondingly in height, and the pieces of foamed latex similarly being compressed closer together as a mass and also being individually compressed which effectively produces the same desirable functions of a solid foam mattress at an appreciably lessened cost. (Scrap latex foam pieces are relatively inexpensive.) Thus, the mattress tub of the invention when utilized with a coil spring produces a mattress having the most desirable characteristics of the most expensive foamed latex mattresses yet provides the same at an appreciably lesser cost, both wholesale and retail.

In further accordance with the present invention, the pieces of foamed latex can be preferably selectively deposited in the valleys to achieve variable compression zones which provide the ultimate in mattress tub comfort in accordance with the present invention. Desirably, a mattress tub might, for example, be divided into five compression zones, namely, a head compression zone, a shoulder compression zone, a hip compression zone, a leg compression zone, and a foot compression zone. By providing different amounts of the foamed latex pieces in the valleys of these different compression zones, the eventual mattress utilizing the mattress tub would provide ultimate underlying support and comfort to a person/user. However, though the latter is desirable, it is recognized that mattresses are not only turned over but are also rotated end-for-end. Thus, the mattress tub is essentially "divided" into three compression zones, namely, a central shoulder/hip compression zone, a head compression zone at one side thereof, and a leg/foot compression zone at an opposite side thereof. By introducing more pieces of foam latex into the shoulder/hip compression zone than in the opposite head and leg/foot zones, which can have equivalent pieces of foamed latex housed therein, the mattress tub provides maximum resistance to compression/weight at the shoulder/hip compression zone and minimum resistance to compression/weight at the remaining compression zones. The overall effect of such a compression zoned mattress tub is to provide essentially uniform softness and feel over the entire length of the mattress tub and an associated mattress, once again providing ultimate comfort to the user.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a fragmentary perspective view of a portion of a mattress, illustrating in solid lines a bottom polymeric/copolymeric layer, a polymeric/copolymeric frame, a convoluted latex foam layer within the frame, pieces of foamed latex in valleys of the convoluted layer, and a top layer closing the tub.

FIG. 2 is an enlarged fragmentary cross-sectional view taken generally along line 2—2 of FIG. 1 showing only the mattress tub, and illustrates the manner in which the valleys of the convoluted latex foam layer are filled with pieces of foamed latex material with the upper or top layer confining the pieces in the valleys to prevent migration thereof.

DESCRIPTION OF THE PREFERRED EMBODIMENT

A novel mattress constructed in accordance with this invention is fully illustrated in FIG. 1 of the drawings and is designated by the reference numeral 10.

The mattress 10 is defined in part by a mattress tub 20.

The mattress tub 20 includes a centrally located generally rectangularly contoured convoluted foamed latex layer 30 having opposite generally parallel ends (not shown) and generally opposite parallel sides (unnumbered). The convoluted latex foam layer 30 also includes a substantially flat lower surface 31 and an opposite convoluted upper surface 32 defined by upwardly directed peaks 33, each having a terminal end (unnumbered) and upwardly opening valleys 34.

The convoluted latex foam layer 30 is peripherally bordered by a frame 40 of polymeric/copolymeric material, such as polystyrene. The frame 40 includes opposite side frame members 41, 42 which are in generally parallel relationship to each other and between which are sandwiched spaced generally parallel end frame members of which only one end frame member 43 is illustrated in FIG. 1 of the drawings. Frame members 41 through 43 are of a substantially polygonal transverse cross-sectional configuration, as is best indicated by the frame member 41 of FIG. 2. Opposite end surfaces of the end frame member 43 abut and are adhesively bonded to the side fame members 41, 42, as is the opposite unillustrated end frame member thereby unifying the four frame members into the one-piece polygonal frame 40.

The lower surface 31 of the convoluted latex foam member 30 and a lower surface 44 of the frame 40 are bonded to an upper surface 51 of a lower layer 50 of polymeric/copolymeric material, such as polystyrene.

The valleys 34 of conventional mattresses and/or mattress pads are devoid of material and simply define air spaces. However, in accordance with this invention each of the valleys 34 is partially or fully filled with a plurality of randomly sized pieces of foamed latex 60. The valleys 34 with the latex foam pieces 60 therein are closed by an upper or top layer 70 of polymeric/copolymeric material, such as polystyrene. A lower surface 71 of the top layer 70 contacts the tops (unnumbered) of the peaks 33 and an upper surface (unnumbered) of the frame 40. The lower surface 71 of the upper layer 70 is preferably bonded to the upper surface (unnumbered) of the frame 40 and, if desired, the lower surface 71 of the upper layer 70 can also be bonded to the uppermost surfaces (unnumbered) of the peaks 33.

The mattress tub 20 rests with the lower layer 50 upon a conventional coil spring structure 80 which includes a number of coil springs united to each other and to upper and lower polygonal frames in a conventional manner. A lower mattress tub corresponding identically in structure to the mattress tub 20 is identified by the reference character 20', but the latter is in inverted relationship to the coil spring structure 80, as compared to the mattress tub 20. In other words, the peaks and valleys (not shown) of the mattress tub or lower mattress tub 20' respectively project and open downwardly whereas the peaks 33 and the valleys 34 of the mattress tub 20 respectively project and open upwardly. Thus, the mattress 10 can be turned or flipped top-for-bottom, vice versa, and end-for-end.

Following conventional practice, a cover of cloth or fabric encases the upper mattress tub 20, the coil spring structure 80 and the lower mattress tub 20', and the latter is generally designated by the reference numeral 85 with appropriate stitching 86 being utilized in a conventional manner to unify all components into the mattress 10.

It is because of the plurality of randomly sized pieces of foamed latex 60 substantially filling the valleys 34 of the convoluted layer 30 which allows what might be best described as progressive compression toward full compression under the weight of a person or sleeper upon the mattress 10. In other words, as a person lies upon the mattress 10, the peaks 33 progressively compress and the compression of the individual peaks 33 varies depending upon the portion of the body of the person lying directly thereabove. As can be readily appreciated, a person hips and mid-section more often than not carry appreciable weight and, therefore, the peaks 33 in these areas are compressed the most in a progressive fashion toward total compression. As the compression of the peaks 33 begins, it is resisted by the pieces of foamed latex 60 which also are progressively compressed or are initially forced more compactly toward each other as a group and thereafter are individually and as a group progressively compressed. Thus, over any particularly area of the mattress 10 upon which a person rests, the peaks 33 and the plurality of randomly sized pieces of foam latex 60 underlying the person progressively compress until a point is reached at which compression ceases and the individual is appropriately softly supported by the overall mattress and particularly the cumulative effects of the progressively compressed peaks 33 and the progressively compressed foam latex pieces 60. The foam latex pieces 60 compress, yet at the same time they resist the compression of the peaks 33, as opposed to the absence of material of any kind in the valleys 34. Under heavy weights, the peaks 33 are compressed the most and the resistance to such compression afforded by the foam latex pieces 60 is at a maximum, whereas under lighter weights the peaks 33 compress less and the resistance offered against such compression by the foam latex pieces 60 is correspondingly reduced. The overall effect of the combination of the peaks 33 and the foam latex pieces 60 is to achieve progressive resistance to compression of the peaks under the influence of different weights of persons supported upon the mattress 10 thereby imparting softness comparable to mattresses constructed entirely of solid unconvoluted latex foam. However, the mattress 10, because of the construction of the mattress tub 20, is appreciably less expensive than a mattress constructed entirely of latex foam material while offering comfort and softness equivalent thereto.

In lieu of filling all of the valleys 34 with pieces of foam latex 60, the valleys 34 can be selectively filled depending upon the weight which is applied to the mattress 10 by a person and the progressive resistance one wishes to offer counteracting such weight. For example, the valleys 34 in a mid-transverse one-third of the mattress could be completely filled with the latex foam pieces 60, whereas the head one-third and the foot one-third ends would be partially filled to provide zones of varying resistance to the progressive compression of the peaks 33.

Although a preferred embodiment of the invention has been specifically illustrated and described herein, it is to be understood that minor variations may be made in the apparatus without departing from the spirit and scope of the invention, as defined the appended claims.

What is claimed is:

1. A mattress comprising at least in part a center convoluted foamed latex layer having opposite ends and opposite sides, said convoluted layer having a substantially flat lower surface and an opposite convoluted upper surface, said convoluted surface including a plurality of upwardly directed peaks and upwardly opening valleys, an upper layer of polymeric/copolymeric material spanning said convoluted upper surface with a lower surface of said upper layer being substantially contiguous to said peaks and substantially closing said valleys, a frame of polymeric/copolymeric material substantially peripherally surrounding said convoluted layer and having an upper surface in underlying bonded relationship to said upper layer upper surface, and a plurality of randomly sized pieces of foamed latex housed within and substantially filling said valleys thereby progressively resisting the compression of said peaks under the influence of different weights of persons supported upon said upper layer while imparting softness comparable to mattresses constructed entirely of solid unconvoluted foamed latex.

2. The mattress as defined in claim 1 wherein the upper layer lower surface is substantially in contact with terminal upper ends of said peaks.

3. The mattress as defined in claim 2 including means for bonding said peak upper ends to the lower surface of said convoluted layer.

4. The mattress as defined in claim 2 wherein a lower layer of polymeric/copolymeric material is in underlying bonded relationship to said foamed latex layer lower surface and said frame.

5. The mattress as defined in claim 1 wherein a lower layer of polymeric/copolymeric material is in underlying bonded relationship to said foamed latex layer lower surface and said frame.

6. The mattress as defined in claim 5 wherein peripheral edges of said upper and lower layers are in substantially alignment with each other and with an outer peripheral surface of said frame.

7. The mattress as defined in claim 6 wherein the upper layer lower surface is substantially in contact with terminal upper ends of said peaks.

8. The mattress as defined in claim 7 including means for bonding said peak ends to the lower surface of said convoluted layer.

9. The mattress as defined in claim 7 including cloth fabric encasing all of said layers.

10. The mattress as defined in claim 9 including a second group of layers and foamed latex pieces corresponding to said first-mentioned layers and foam latex pieces with coil springs interposed therebetween.

11. The mattress as defined in claim 1 wherein a lower layer of polymeric/copolymeric material is in underlying bonded relationship to said foamed latex layer lower surface and said frame, and said frame is formed of opposite pairs of side and end frame members.

12. A mattress comprising at least in part a center convoluted foamed latex layer having opposite ends and opposite sides, said convoluted layer having a substantially flat lower surface and an opposite convoluted upper surface, said convoluted surface including a plurality of upwardly directed peaks and upwardly opening valleys, an upper layer of polymeric/copolymeric material spanning said convoluted upper surface with a lower surface of said upper layer being substantially contiguous to said peaks and substantially closing said valleys, a frame of polymeric/copolymeric material substantially peripherally surrounding said convoluted layer and having an upper surface in underlying bonded relationship to said upper layer upper surface, a plurality of randomly sized pieces of foamed latex housed within and substantially filling said valleys thereby progressively resisting the compression of said peaks under the influence of different weights of persons supported upon said upper layer while imparting softness comparable to mattresses constructed entirely of solid unconvoluted foamed latex, and at least two adjacent transverse zones of said valleys being filled with different amounts of the foamed latex pieces to create zones of different resistance resisting the compression of the peaks within the respective zones.

13. The mattress as defined in claim 12 wherein the upper layer lower surface is substantially in contact with terminal upper ends of said peaks.

14. The mattress as defined in claim 13 including means for bonding said peak end to the lower surface of said convoluted layer.

15. The mattress as defined in claim 13 wherein a lower layer of polymeric/copolymeric material is in underlying bonded relationship to said foamed latex layer lower surface and said frame.

16. The mattress as defined in claim 12 wherein a lower layer of polymeric/copolymeric material is in underlying bonded relationship to said foamed latex layer lower surface and said frame.

17. The mattress as defined in claim 16 wherein peripheral edges of said upper and lower layers are in substantially alignment with each other and with an outer peripheral surface of said frame.

18. The mattress as defined in claim 12 wherein a lower layer of polymeric/copolymeric material is in underlying bonded relationship to said foamed latex layer lower surface and said frame, and said frame is formed of opposite pairs of side and end frame members.

* * * * *